US007011488B2

(12) United States Patent
Masumoto et al.

(10) Patent No.: US 7,011,488 B2
(45) Date of Patent: Mar. 14, 2006

(54) SLIDE ARM FOR WORKING MACHINE

(75) Inventors: Nobuyoshi Masumoto, Hirakata (JP); Tatsushi Itoh, Hirakata (JP); Toshihiko Sakashita, Komatsu (JP)

(73) Assignees: Komatsu Ltd., Tokyo (JP); Kabushiki Kaisha Muroto Tekkosho, Komatsu (JP)

( * ) Notice: Subject to any disclaimer, the term of this patent is extended or adjusted under 35 U.S.C. 154(b) by 0 days.

(21) Appl. No.: 10/363,020

(22) PCT Filed: Aug. 29, 2001

(86) PCT No.: PCT/JP01/07448

§ 371 (c)(1),
(2), (4) Date: Jun. 16, 2003

(87) PCT Pub. No.: WO02/20907

PCT Pub. Date: Mar. 14, 2002

(65) Prior Publication Data

US 2004/0131459 A1 Jul. 8, 2004

(30) Foreign Application Priority Data

Sep. 4, 2000 (JP) ..... 2000-266887

(51) Int. Cl.
*E02F 3/39* (2006.01)

(52) U.S. Cl. ..... 414/694; 52/118; 212/350; 414/718

(58) Field of Classification Search ..... 414/694, 414/718, 728, 722; 212/177, 264, 348, 349, 212/350; 52/118
See application file for complete search history.

(56) References Cited

U.S. PATENT DOCUMENTS 4,357,785 A * 11/1982 Eklund ..... 52/632
4,436,476 A * 3/1984 Yoritomi ..... 414/718 X
4,728,249 A 3/1988 Gano
5,092,733 A * 3/1992 Kishi ..... 414/718
5,592,762 A * 1/1997 Hendron et al. ..... 414/694 X

FOREIGN PATENT DOCUMENTS

DE 2317595 * 10/1974 ..... 212/350

(Continued)

OTHER PUBLICATIONS

PCT Notification (dated Feb. 12, 2003) for PCT/JP01/07448 and copy of English translation of the International Preliminary Examination Report.

*Primary Examiner*—Donald W. Underwood
(74) *Attorney, Agent, or Firm*—Frishauf, Holtz, Goodman & Chick, P.C.

(57) ABSTRACT

A slide arm for a work implement is provided, which is simply structured to obtain improved assembling precision thereby ensuring smooth operation. To this end, the slide arm is such that a plurality of tubular structural bodies (i.e., outer and inner tubes), each of which is formed by bending a one-piece plate into a shape having a substantially triangular cross-section and circular vertex portions, are telescoped one within the other with sliding members (i.e., plain bearing units and slide block pieces) interposed between them at the vertex portions and such that a sliding mechanism is disposed for sliding the tubular structural bodies.

6 Claims, 6 Drawing Sheets

FOREIGN PATENT DOCUMENTS

| | | | | |
|---|---|---|---|---|
| GB | 2082143 | * | 3/1982 | ..... 212/350 |
| JP | 61-41794 | Y2 | 11/1986 | |
| JP | 63-16713 | Y2 | 5/1988 | |
| JP | 03-019329 | | 1/1991 | |
| JP | 8-245177 | A | 9/1996 | |
| JP | 10-101293 | A | 4/1998 | |
| JP | 2000-51932 | A | 2/2000 | |
| JP | 2001-262607 | A | 9/2001 | |
| WO | WO 99/04103 | | 1/1999 | |
| WO | WO 99/04104 | | 1/1999 | |

* cited by examiner

SLIDE ARM FOR WORKING MACHINE

This application is a U.S. National Phase Application under 35 USC 371 of International Application PCT/JP01/07448 filed Aug. 21, 2001.

TECHNICAL FIELD

The present invention relates to a slide arm for a work implement, which is mainly adapted for use in construction equipment.

BACKGROUND ART

As a tubular structural member incorporated in construction equipment as a part of a work implement, there have been widely used hollow rectangular cross-section members made up of four plate materials, such as hydraulic excavator booms, deep excavation system arms and mobile crane booms. Such a rectangular cross-section structure is the most popular for these members because it provides high strength for the members to stand harsh working environment.

However, the typical booms and arms of a rectangular cross-section tend to be heavy in weight as a whole. If a work implement having such a heavy long member as a chief component is mounted on the front part of a travelling vehicle, the vehicle will loose a balance of total weight. Therefore, there arises a need for countermeasures such as, for example, use of a heavy counterweight and elongation of the rear end of the vehicle. In addition, the rectangular cross-section members have revealed the disadvantage that the total weight of the vehicle equipped with the work implement increases, accompanied with many problems such as increased fuel cost.

With the intention of reducing the weight of a work implement provided with a tubular structural member, many attempts have been made to provide triangular cross-section tubular structural members which are more likely to achieve weight reduction compared to the conventional rectangular cross-section tubular members. For example, Japanese Patent Publication (KOKOKU) Gazette No. 3-19329 discloses a boom of an inverted trapezoidal shape for a hydraulic excavator, which is tapered down toward the lower face. Japanese Patent Publication (KOKAI) Gazette No. 2000-51932 discloses a method of producing a triangular tube for use in a construction vehicle. The triangular tube is produced in such a way that one plate is bent and but-welded in one place and then, each corner is formed into a circular arc shape, thereby increasing the quality of appearance to achieve high precision.

U.S. Pat. Publication No. 4,728,249 discloses a telescoping boom formed by assembling triangular cross-section members. As shown in FIGS. 6(*a*) and 6(*b*), this telescoping boom 100 having a triangular cross-section structure has a hexagonal cross-section in the strict sense and its three sides 101 are shorter than the other three sides 102. The panels corresponding to these sides are connected by welding their respective longitudinal side edges. The inner boom section nested in the outer boom section is supported and guided by rollers (not shown) mounted to the outer boom section.

As described above, various members of tubular structure for use in work implements have been devised heretofore in the prior art, but there are still many problems to be solved in achieving rigid, compact structures such as booms having the telescopic function. Specifically, the boom disclosed in U.S. Pat. No. 4,728,249, in which a triangular sectional configuration (substantially hexagonal sectional configuration) is employed instead of the known rectangular sectional configuration, has accomplished the object of weight reduction but imposed the problem of an increased number of welded places which problem leads to decreased processing accuracy, to say nothing of increased manufacturing cost. In addition, if processing accuracy decreases, outside dimension larger than necessary is required because a large gap has to be provided between the outer tube and the member telescopically received in the outer tube. Therefore, the inner tube (i.e., telescopically moving boom) is structured to be guided by guide rollers mounted on the outer boom section. This arrangement is undesirable in view of weight reduction.

The triangular tube production method disclosed in Japanese Patent Publication Gazette No. 2000-51932 is advantageous in manufacturing a tubular structural member of a triangular sectional configuration but should be further contemplated as to what kind of structure needs to be employed for producing a tubular structural member having a telescopic function, that is, a slide arm, by use of the technique disclosed in the above publication.

The structure disclosed in Japanese Patent Publication Gazette No. 3-19329 is associated with a single member having an inverted trapezoidal sectional configuration. Like the above-described boom requiring a welding process, this also presents outstanding problems in the production of a slide arm which is an object of the invention.

The present invention has been made in such a background and an object of the invention is therefore to provide a slide arm for a work implement which has a simplified structure as well as increased assembling precision and therefore can perform smooth operation.

DISCLOSURE OF THE INVENTION

The above object can be accomplished by a slide arm for a work implement according to the invention, wherein a plurality of tubular structural bodies, each of which is formed by bending a one-piece plate into a shape having a substantially triangular cross-section and circular vertex portions, are telescoped one within the other with sliding members interposed between them at the vertex portions and a sliding mechanism is disposed for sliding the tubular structural bodies, and wherein the sliding members are mounted to the inner surface of an open end of an outer tubular structural body at the vertex portions thereof and mounted to the rear end of an inner tubular structural body, the outer tubular structural body supporting the inner tubular structural body.

According to the invention, the telescoped tubular structural bodies are circular triangle in cross-section and have circular vertex portions. An inner tubular structural body is supported on an outer tubular structural body by sliding members disposed at positions corresponding to the vertex portions within the gap between the outer and inner tubular structural bodies, so that the inner and outer tubular structural bodies having the similar sectional configuration are automatically aligned. Accordingly, improved assembling precision can be ensured. By making the sliding member unbulky in structure, the gap between the inner and outer tubular structural bodies can be narrowed, so that a high-rigid slide arm can be constructed without involving an immoderate structure. In consequence, weight reduction can be accomplished.

In addition, mounted to the inner surface of an open end of an outer tubular structural body at the vertex portions thereof and mounted to the rear end of an inner tubular structural body, the outer tubular structural body supporting the inner tubular structural body. With this arrangement, the gap between the telescopically moving tubular structural body and the tubular structural body for supporting the moving tubular structural body can be narrowed to promote weight reduction. In addition, since supporting guidance is carried out only at the vertex portions of the tubular structural bodies of triangular cross-section and each vertex portion has a curved surface, the function of self-aligning the moving section with respect to the supporting section can be obtained and sliding resistance can be reduced, resulting in smooth telescopic movement. Herein, the sliding members may be plain bearings each having a circular arc surface fur supporting and guiding the curved surfaces of the vertex portions of the tubular structural bodies.

Preferably, in the invention, a bracket for supporting the outer tubular structural body so as to be mounted on a machine body is disposed at the proximal end of a linear actuator for telescopically moving the inner tubular structural body. This arrangement brings about such an advantage that the inner tubular structural body can be utilized throughout the full stroke of telescopic movement caused by the linear actuator. Therefore, a configuration useful in structural point of view can be achieved.

The leading end of the slide arm of the invention is provided with a bracket for retaining an excavating bucket. This allows the weight of the slide arm to be reduced where it is attached to the leading end of the boom of a hydraulic excavator and used as a work implement for deep excavation, and therefore, it becomes possible to increase the capacity of the bucket in order to achieve improved operation efficiency. In addition, the above arrangement has such an effect that the extending length of the slide arm can be increased to enable excavating operation in deeper areas.

Preferably, a sheave for a suspension rope is attached to the leading end of the slide arm through a sheave bracket. With this arrangement, the weight of the slide arm can be reduced when used as a slide boom for a crane so that the hoisting capability of the slide arm can be increased compared to the slide booms having the conventional structures.

Since the slide arm of the invention can be accordingly increased in rigidity and reduced in weight, it is applicable to apparatuses and equipment in which a work implement of various types is attached to the leading end of a slide arm and operation is performed by linearly moving the work implement.

BEST MODE FOR CARRYING OUT THE INVENTION

Referring now to the accompanying drawings, a slide arm for a work implement will be concretely described according to a preferred embodiment of the invention.

Figure 1:
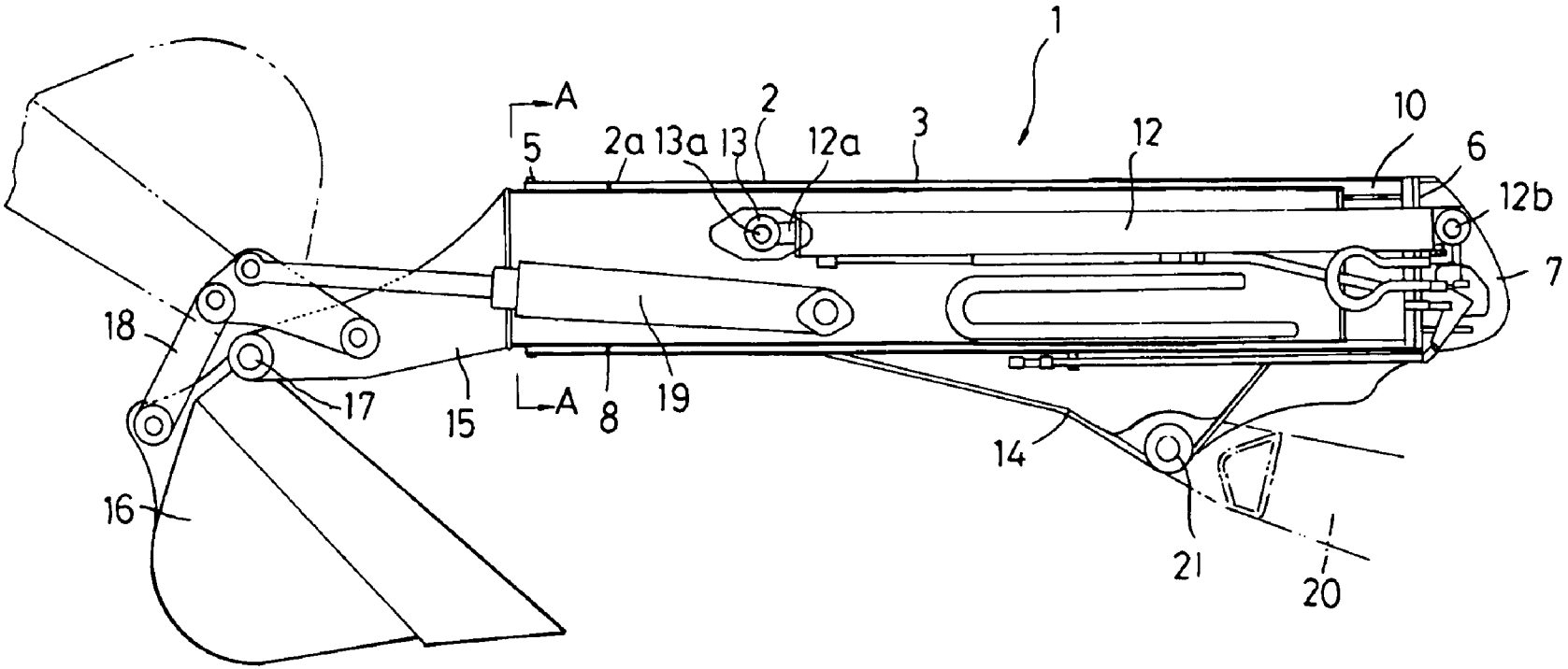
FIG. 1 is a longitudinal sectional view of a slide arm constructed according to one embodiment of the invention.

FIG. 1 is a longitudinal sectional view of a slide arm constructed according to one embodiment of the invention.

Figure 2:
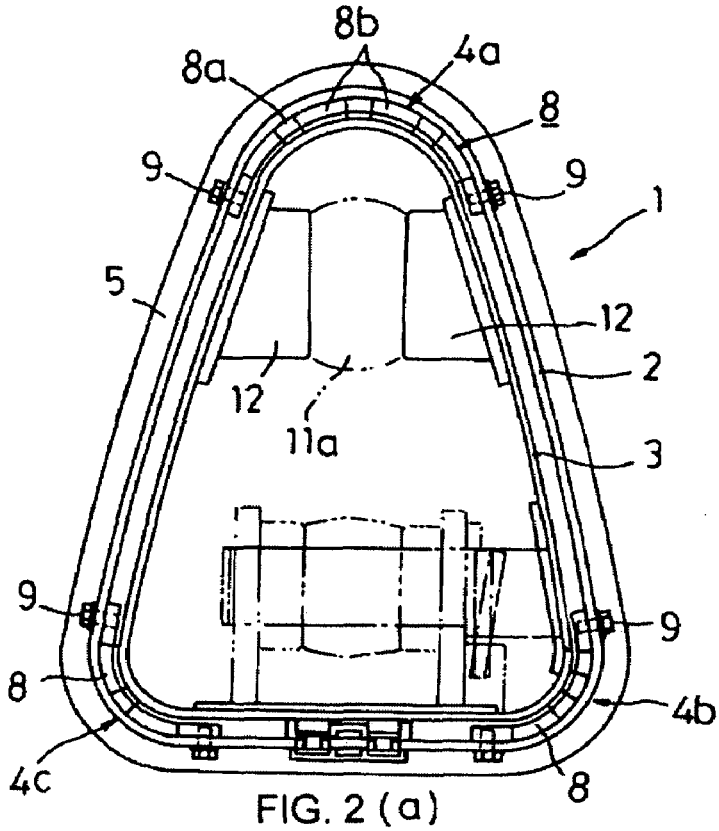
FIG. 2(*a*) is an enlarged sectional view taken along line A—A of FIG. 1 and FIG. 2(*b*) is an external side view of the front end of the arm.
Figure 2:
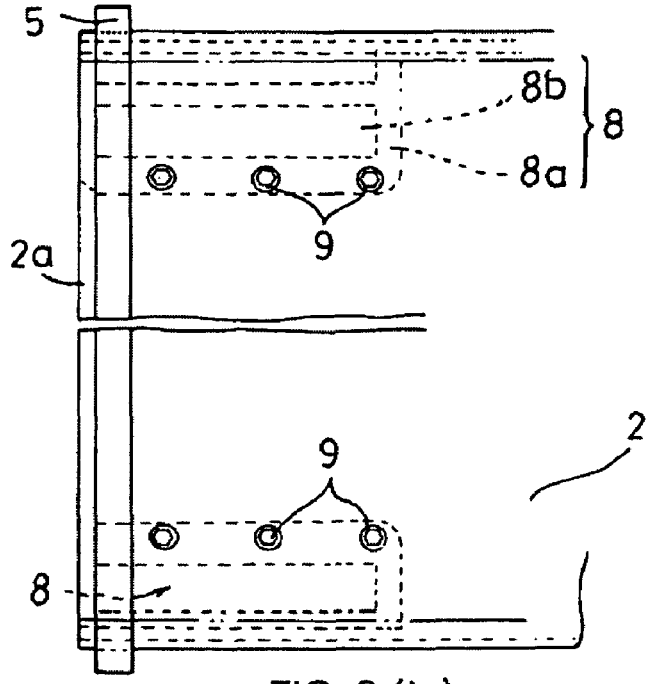
Figure 3B:
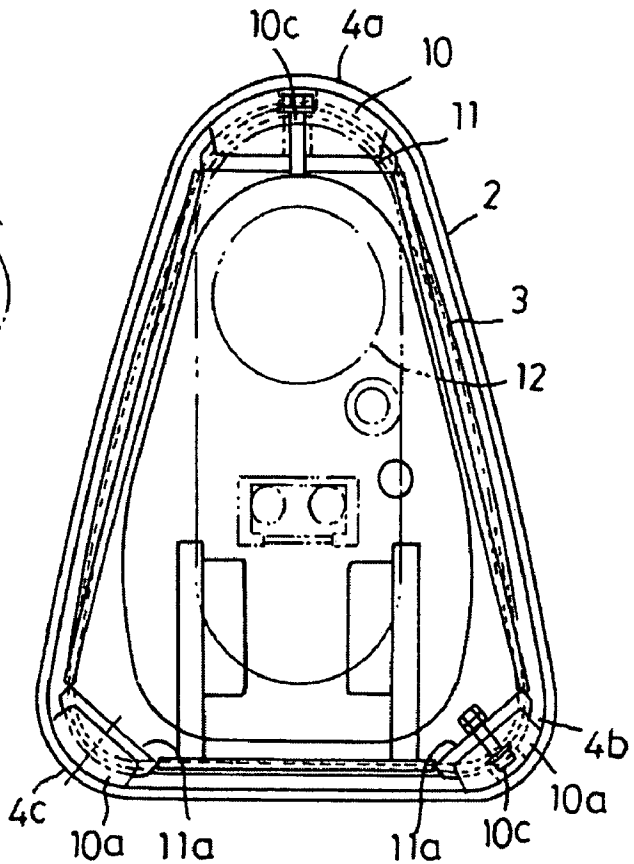
FIG. 3(*a*) is an enlarged sectional view of the rear end of the slide arm and FIG. 3(*b*) is a sectional view taken along line b—b of FIG. 3(*a*).
Figure 3A:
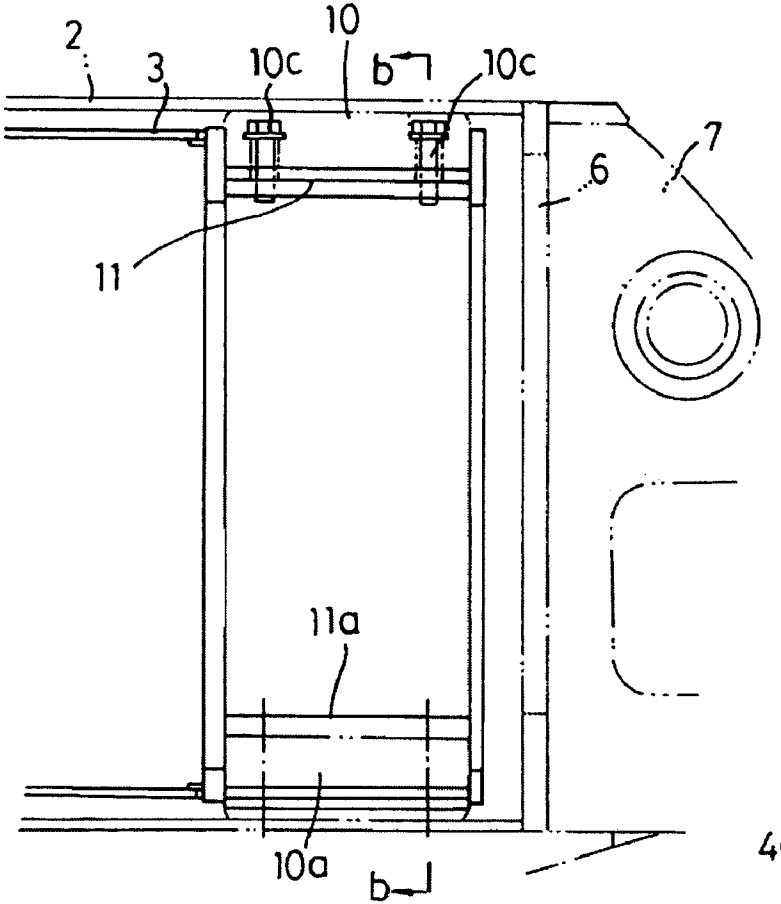

FIG. 2(*a*) is an enlarged sectional view taken along line A—A of FIG. 1 and FIG. 2(*b*) is an external side view of the front end of the arm. FIG. 3(*a*) is an enlarged sectional view of the rear end of the slide arm and FIG. 3(*b*) is a sectional view taken along line b—b of FIG. 3(*a*).

This embodiment is associated with a case where a slide arm is used as a deep excavation loading apparatus attached to the boom of a hydraulic excavator.

In the present embodiment, a slide arm 1 is constituted by an outer tube 2 having a specified length and an inner tube 3 having a cross-section similar to that of the outer tube 2, these tubes 2, 3 being telescopically combined. The outer tube 2 is constructed in such a way that a single steel plate is bent into a tubular form having a substantially triangular cross-section and then, the leading and trailing edges of the steel plate are joined by welding in an axial direction at the center of the base of the steel plate bent into the form of a triangular cross-section tube. The outer tube 2 has vertex portions 4*a*, 4*b*, 4*c* which correspond to the vertexes of its triangular cross-section. In cross-section, the vertex portions 4*a*, 4*b*, 4*c* respectively have the shape of a circular arc having a specified radius. The inner tube 3 has the same configuration as the outer tube 2. It should be noted that the outer and inner tubes 2, 3 described herein correspond to the outer tubular structural body and the inner tubular structural body, respectively, of the invention.

The outer tube 2 is open at its front end 2*a* and a reinforcing material 5 is integrally welded to the outer periphery of the open end 2*a*. An end plate 6 which substantially fits the contour of the outer tube 2 is welded to the rear end of the outer tube 2 so that the outer tube 2 is unsusceptible to deformation. In the outer surface of the end plate 6 positioned at the rear end, a bracket 7 is attached in an axial direction. The bracket 7 is made of two parallel plates spaced at a specified distance. The bracket 7 is used for attachment of the proximal end of a hydraulic cylinder 12 (corresponding to the linear actuator of the invention) which is disposed within the slide arm 1 for sliding operation. The hydraulic cylinder 12 is inserted into the tubular body, projecting through a through hole defined in the end plate 6.

In the front end 2*a* of the outer tube 2, plain bearing units 8 (corresponding to the plain bearings of the invention) are mounted, by means of mounting bolts 9 inserted from the outer surface, on the inner circular arc surfaces of the vertex portions 4*a*, 4*b*, 4*c* of the outer tube 2 so as to face the circular arc surfaces of the vertex portions of the triangular cross-section inner tube 3 telescoped in the outer tube 2. As shown in FIGS. 2(*a*) and 2(*b*), the plain bearing units 8 are respectively comprised of a holder 8*a* and a plurality of self-lubricating flat bearing pieces 8*b* which are disposed on the holder 8*a* so as to be aligned in a longitudinal direction. Each plain bearing unit 8 is designed to have a contact surface which fits the outer circular arc surface of each vertex portion of the inner tube 3.

The outside dimension of such an inner tube 3 telescoped in the outer tube 2 is determined so as to leave a small gap between the outer peripheral surface of the inner tube 3 and the inner peripheral surface of the outer tube 2. As shown in FIGS. 3(*a*) and 3(*b*), slide block pieces 10, 10*a*, 10*a* (corresponding to the plain bearings of the present invention) are securely attached to the rear end of the inner tube 3 in relation to the inner surfaces of the vertex portions 4*a*, 4*b*, 4*c*, respectively, of the outer tube 2. The slide block pieces 10, 10*a*, 10*a* are made from a self-lubricating material and their surfaces are curved so as to be in contact with and held by the inner circular arc surfaces of the vertex portions of the outer tube 2 respectively. In addition, the slide block pieces 10, 10*a*, 10*a* are secured, by means of bolts 10*c*, to block piece mounting seats 11, 11*a*, 11*a*, respectively, provided at the rear end of the inner tube 3.

The front part of the inner tube 3 thus inserted in the outer tube 2 is accordingly supported, at the outer peripheries of its vertex portions, by the plain bearing units 8 disposed at the inner surface of the front end of the outer tube 2. The rear part of the inner tube 3 is slidably retained, with the slide block pieces 10, 10*a*, 10*a* which are attached to the rear end of the inner tube 3 being in contact with the inner surfaces of the vertex portions of the outer tube 2.

The inner and outer tubes 2, 3 thus combined are designed such that the hydraulic cylinder 12 is positioned within the inner tube 3, with its proximal end 12*b* being supported to the bracket 7 disposed at the rear end of the outer tube 2. A rod 12*a* for the hydraulic cylinder 12 has right and left end portions at the leading end thereof, the end portions projecting within the inner tube 3 so as to intersect its axis and being coupled by means of pins 13*a* to bosses 13 provided at right and left sides. The provision of this hydraulic cylinder 12 enables the telescopic sliding movement of the slide arm 1.

A bucket mounting bracket 15 is secured to the leading end of the inner tube 3 so as to project forward in an axial direction. A bucket 16 is supported on the bucket mounting bracket 15 at its mounting proximal end by means of a pin 17 and coupled to the rod end of a bucket operation hydraulic cylinder 19 so as to be openable and closable, using a link mechanism 18, the bucket operation hydraulic cylinder 19 being disposed at the leading end of the inner tube 3.

Figure 4:
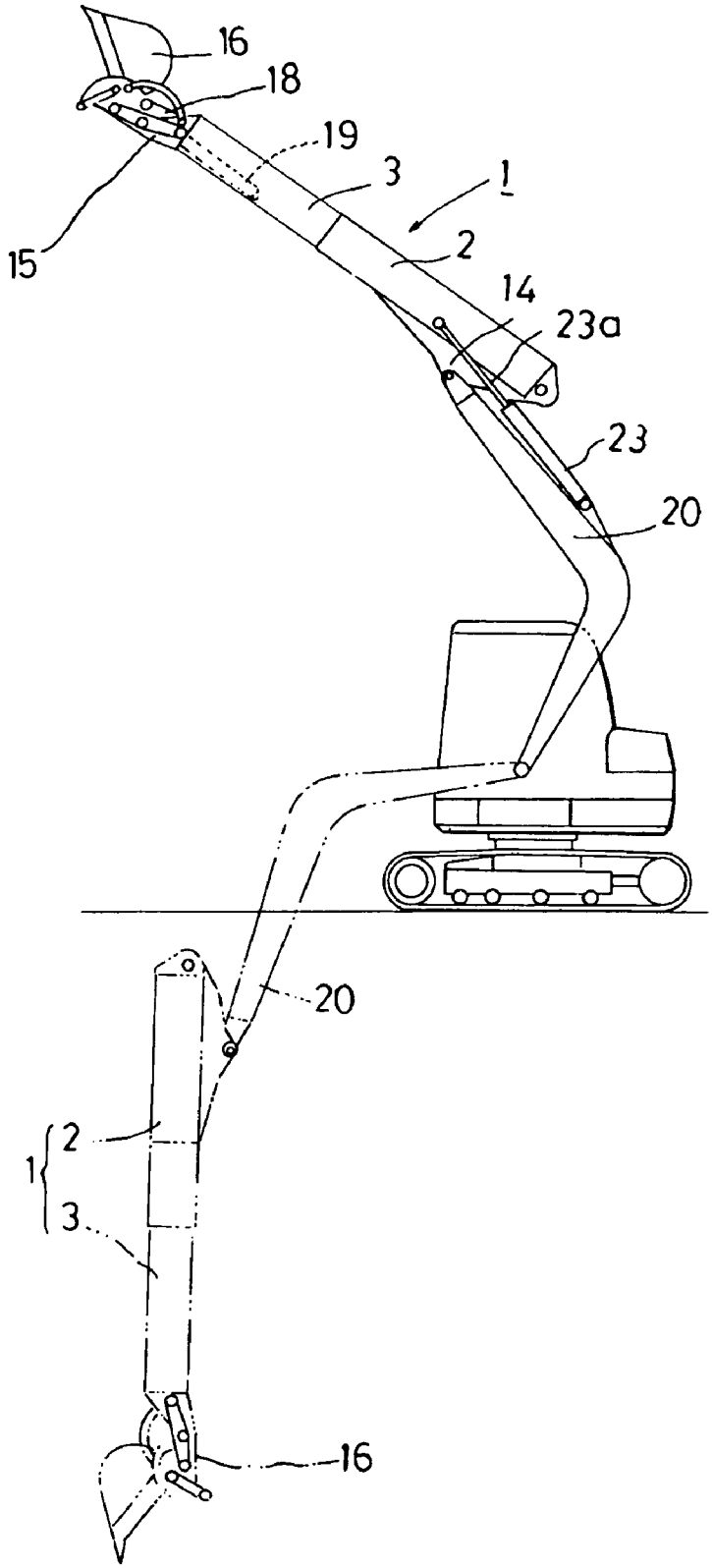
FIG. 4 shows an example in which a work implement of the present embodiment is mounted on a hydraulic excavator as a deep excavation loading apparatus.

The slide arm 1 having the bucket 16 thus arranged is coupled to the leading end of a boom 20 for a hydraulic shovel with a pin 21 through a supporting bracket 14 which is attached to a side face of the outer tube 2, more concretely, to the side corresponding to the base when viewing the triangular cross-section of the slide arm 1. The slide arm 1 is coupled to an end of a rod 23*a* of a hydraulic cylinder 23 such that the slide arm 1 can be hoisted (see FIG. 4). The hydraulic cylinder 23 is attached to the boom 20 for hoisting operation. When feeding hydraulic oil to the hydraulic cylinder 12 for sliding operation incorporated in the slide arm 1 to forwardly and backwardly move the rod 12*a* (piston rod), the part of the inner tube 3 extending between its leading end and intermediate portion is retained and guided by the plain bearing units 8 disposed inside the front end of the outer tube 2 as described earlier and the rear end part of the inner tube 3 is retained and guided on the inner surface of the outer tube 2 by the slide block pieces 10, 10*a*, 10*a* which are disposed at the rear end of the inner tube 3. Accordingly, the slide arm 1 of the present embodiment performs forward and backward movement corresponding to one stroke of the rod 12*a*.

Since all the vertex portions 4*a*, 4*b*, 4*c* of the inner and outer tubes 2, 3 having a substantially triangular cross-section are in the form of a circular arc curved surface and the inner and outer tubes 2, 3 have the similar configuration, the inner tube 2 is slidably supported on the outer tube 2 by the curved surfaces of the vertex portions 4*a*, 4*b*, 4*c* during the telescopic movement of the inner and outer tubes 2, 3, so that the inner and outer tubes 2, 3 can be self-aligned and can slide in a coaxial condition without chattering. In addition, since the inner tube 2 is slidably supported only at the vertex portions, sliding resistance occurring at the time of the sliding movement can be considerably reduced compared to the conventional method. Therefore, high power is not required for the sliding movement and driving power can be effectively utilized at the time of the lifting/lowering operation of the excavation bucket. Further, high rigidity and weight reduction can be achieved by employing the known triangular cross-section structure. Thanks to these effects, energy consumption can be restrained to ensure effective operation.

The present embodiment is advantageous in that the gap between the inner and outer tubes 2, 3 of the slide arm 1 can be easily minimized so that a slide arm having the desired capability can be attained without significantly increasing the cross sectional area and weight reduction can be more effectively accomplished. Additionally, since the slide arm is formed by bending a single steel plate into a shape having a substantially triangular cross-section, it can be formed from a thin plate and the plate is welded at only one place, thereby increasing the productivity and appearance quality of the slide arm. Particularly, if the invention is applied to the slide arm of a deep excavation loading apparatus as described earlier, the slide arm itself can be made to be lightweight and the capacity of the bucket can be increased by the amount corresponding to the reduced weight of the slide arm. In consequence, the amount of lifted soil per operation can be increased, thereby achieving further improved operation efficiency.

In addition, the stroke of the slide arm can be extended according to the reduced weight of the slide arm, thereby increasing the depth of excavation. As a result, deep excavation which has been deemed as difficult operation is enabled.

The slide arm of the invention can be made in the form of a multistage slide arm by combining a plurality of tubular bodies each having a substantially triangular cross-section. In this case, the plain bearing units 8 are assembled to the front open ends of the tubular bodies and the slide block pieces 10 (10*a*) are assembled to the rear ends of the inner tubular bodies in the above-described manner similarly to the foregoing embodiment, so that the plurality of tubular bodies having the similar cross-section are slidably fitted together and telescopically moved by the known sliding actuator means.

Figure 5:
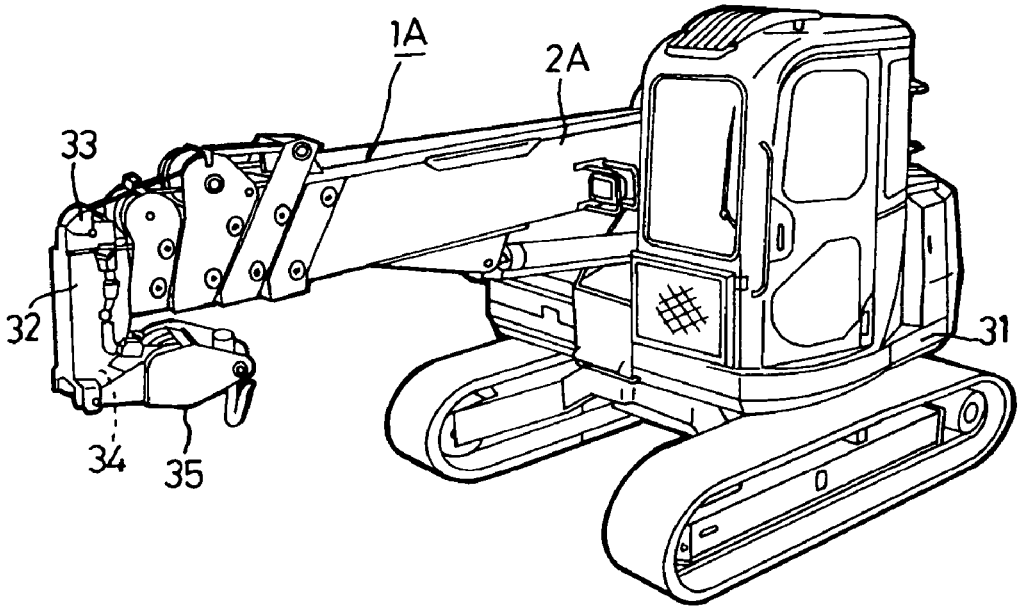
FIG. 5 shows an example in which the work implement of the present embodiment is used as a crane.
Figure 6A:
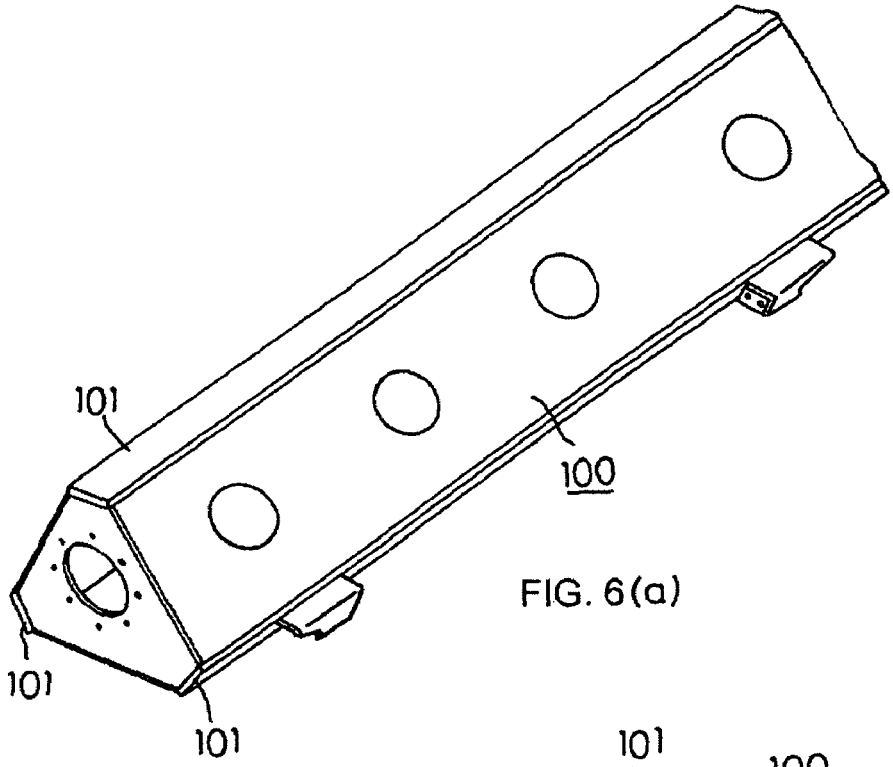
FIG. 6 is views showing a concrete example of the prior art, wherein FIGS. 6(*a*) and 6(*b*) are a perspective view and cross-sectional view, respectively, of an arm.
Figure 6B:
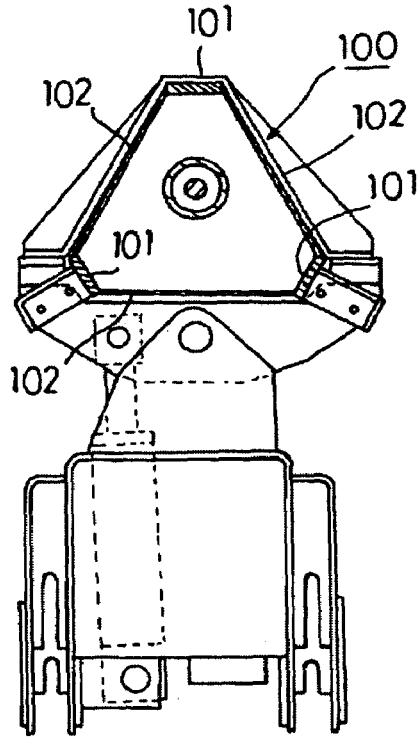

The multistage slide arm 1A having the above structure can be utilized as a multistage slide arm for a crane, by employing the structure such as shown in FIG. 5 in which the outermost tubular body 2A is supported to the machine body (e.g., the revolving superstructure 31 of a traveling vehicle) such that the tubular body 2A can be hoisted at its base; guide sheaves 33, 34 are attached to a sheave bracket 32 mounted on the leading end of the multistage slide arm 1A; and a suspension rope to be wound up by or unwind from a hoist (not shown) mounted on the machine side is wound around the guide sheaves 33, 34 to hang a hook 35.

Since the slide arm of the invention has a structure in which the gap between the assembled inner and outer tubes can be narrowed and which has high assembling precision and does not cause chattering during the telescopic movement, the slide arm can perform smooth sliding movement even if it is constituted by two or more tubular bodies. Further, the cross-sectional area of each tubular body can be minimized and therefore, whole of the slide arm can be made to be compact even if it has a multistage structure. In addition, since each tubular body can be made to be lightweight as discussed earlier, increased hoisting capability can be obtained.

According to the purpose of the invention, the slide arm can be applied not only to deep excavation loading apparatuses and crane booms, but also to other industrial machines requiring the telescopic function.

What is claimed is:

1. A slide arm for a work implement, said slide arm comprising:

a plurality of tubular structural bodies including an outer tubular structural body and an inner tubular structural body, each of which is formed by bending a one-piece plate into a shape having a substantially triangular cross-section and circular vertex portions, wherein the inner tubular structural body is telescoped within the outer tubular structural body;

sliding members interposed between the outer tubular structural body and the inner tubular structural body at the vertex portions; and a sliding mechanism for sliding the tubular structural bodies, wherein a group of the sliding members are mounted to an inner surface of an open end of the outer tubular structural body at the vertex portions thereof, and a group of the sliding members are mounted to a rear end of the inner tubular structural body, wherein the outer tubular structural body supports the inner tubular structural body, wherein the sliding members comprise plain bearing units each having a circular arc surface for supporting and guiding curved surfaces of the circular vertex portions of the tubular structural bodies, and wherein each of the plain bearing units comprises a plurality of self-lubricating flat bearing pieces that are positioned such that a longitudinal direction of each said bearing piece extends along a longitudinal direction of the tubular structural bodies.

2. The slide aria according to claim 1, wherein a bracket is disposed at a proximal end of the outer tubular structural body so as to attach thereto a proximal end of a linear actuator for telescopically moving the inner tubular structural body.

3. The slide arm according to claim 1, wherein a bracket for retaining an excavating bucket is disposed at a leading end of the slide arm.

4. The slide arm according to claim 1, wherein a sheave for a suspension rope is attached to a leading end of the slide arm through a sheave bracket.

5. The slide arm according to claim 2, wherein a bracket for retaining an excavating bucket is disposed at a leading end of the slide arm.

6. The slide arm according to claim 2, wherein a sheave for a suspension rope is attached to a leading end of the slide arm through a sheave bracket.

* * * * *

UNITED STATES PATENT AND TRADEMARK OFFICE

CERTIFICATE OF CORRECTION

PATENT NO. : 7,011,488 B2
APPLICATION NO. : 10/363020
DATED : March 14, 2006
INVENTOR(S) : Nobuyoshi Masumoto It is certified that error appears in the above-identified patent and that said Letters Patent is hereby corrected as shown below:

Column 8, line 10 (claim 2, line 1), change “aria” to --arm--.

Signed and Sealed this

Ninth Day of September, 2008

JON W. DUDAS
*Director of the United States Patent and Trademark Office*